US007461991B2

(12) United States Patent
Dalancourt et al.

(10) Patent No.: US 7,461,991 B2
(45) Date of Patent: Dec. 9, 2008

(54) QUICK RELEASE MECHANISM FOR ACCESS TO INK RESERVOIR OF WRITING INSTRUMENT

(75) Inventors: Jean-Patrick Dalancourt, St. Etienne de Montluc (FR); Jean-Luc Couedou, Herblain (FR)

(73) Assignee: Waterman SAS, Paris (FR)

( * ) Notice: Subject to any disclaimer, the term of this patent is extended or adjusted under 35 U.S.C. 154(b) by 440 days.

(21) Appl. No.: 11/184,106

(22) Filed: Jul. 19, 2005

(65) Prior Publication Data

US 2007/0071539 A1 Mar. 29, 2007

(51) Int. Cl.
*B43K 5/00* (2006.01)

(52) U.S. Cl. ..... 401/251; 401/208

(58) Field of Classification Search ..... 401/251, 401/221, 208

See application file for complete search history.

(56) References Cited

U.S. PATENT DOCUMENTS

| | | | | | |
|---|---|---|---|---|---|
| D68,281 | S | | 9/1925 | Todd, Jr. | D19/49 |
| D163,606 | S | | 6/1951 | Horwitch | D19/48 |
| 2,750,926 | A | | 9/1956 | Smith | |
| D179,538 | S | | 1/1957 | Harper et al. | D19/49 |
| 2,917,024 | A | * | 12/1959 | Westmoreland | 401/157 |
| D242,449 | S | | 11/1976 | Jahraus | D19/45 |
| D250,478 | S | | 12/1978 | Jahraus | D19/45 |
| D254,912 | S | | 5/1980 | Ito | D19/48 |
| 4,533,271 | A | * | 8/1985 | Sansevero | 401/29 |
| 4,755,075 | A | * | 7/1988 | Leem | 401/75 |
| 4,974,982 | A | * | 12/1990 | Nielson | 401/195 |
| D321,207 | S | | 10/1991 | Granoff | D19/49 |
| D339,378 | S | | 9/1993 | Verhaegue | D19/51 |
| 5,642,953 | A | * | 7/1997 | Kobayashi et al. | 401/30 |
| 5,938,361 | A | * | 8/1999 | Yasunaga | 401/209 |
| D440,603 | S | | 4/2001 | Restrepo | D19/51 |
| 6,250,832 | B1 | | 6/2001 | Del Vecchio | 401/151 |
| D504,154 | S | | 4/2005 | Collin | D19/49 |
| 2005/0036303 | A1 | | 2/2005 | Yu et al. | |
| 2005/0100388 | A1 | * | 5/2005 | Bedhome et al. | 401/35 |

FOREIGN PATENT DOCUMENTS

| | | | |
|---|---|---|---|
| DE | 760 854 | | 9/1952 |
| GB | 688893 | * | 3/1953 |
| GB | 878104 | | 9/1961 |
| GB | 1041630 | * | 9/1966 |

OTHER PUBLICATIONS

International Search Report from PCT/IB2005/002905.
Written Opinion of the International Searching Authority from PCT/IB2005/002905.

* cited by examiner

*Primary Examiner*—David J Walczak
(74) *Attorney, Agent, or Firm*—Marshall, Gerstein & Borun LLP

(57) ABSTRACT

A writing instrument having a selective engagement mechanism includes a first barrel portion with a writing tip and a second barrel portion. A docking collar with male projections extending laterally therefrom is associated with one of the first and second barrel portions, and for each male projection, at least one complementary track is provided in a track-carrying member associated with the other of the first and second barrel portions. A biasing element, such as a gasket, facilitates securement of the first and second barrel portions when engaged with one another.

2 Claims, 3 Drawing Sheets

FIG. 6
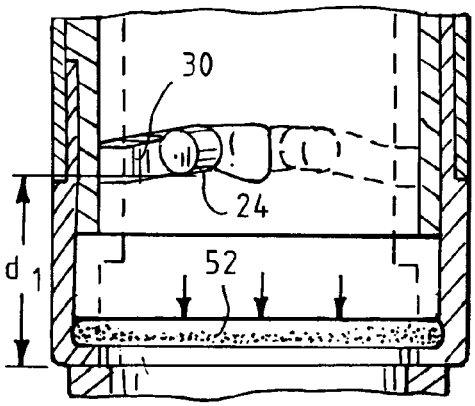
FIG. 7
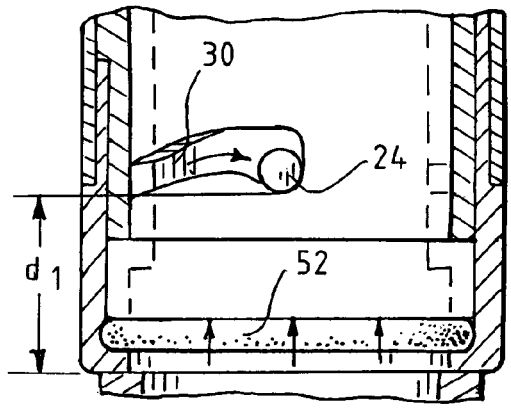
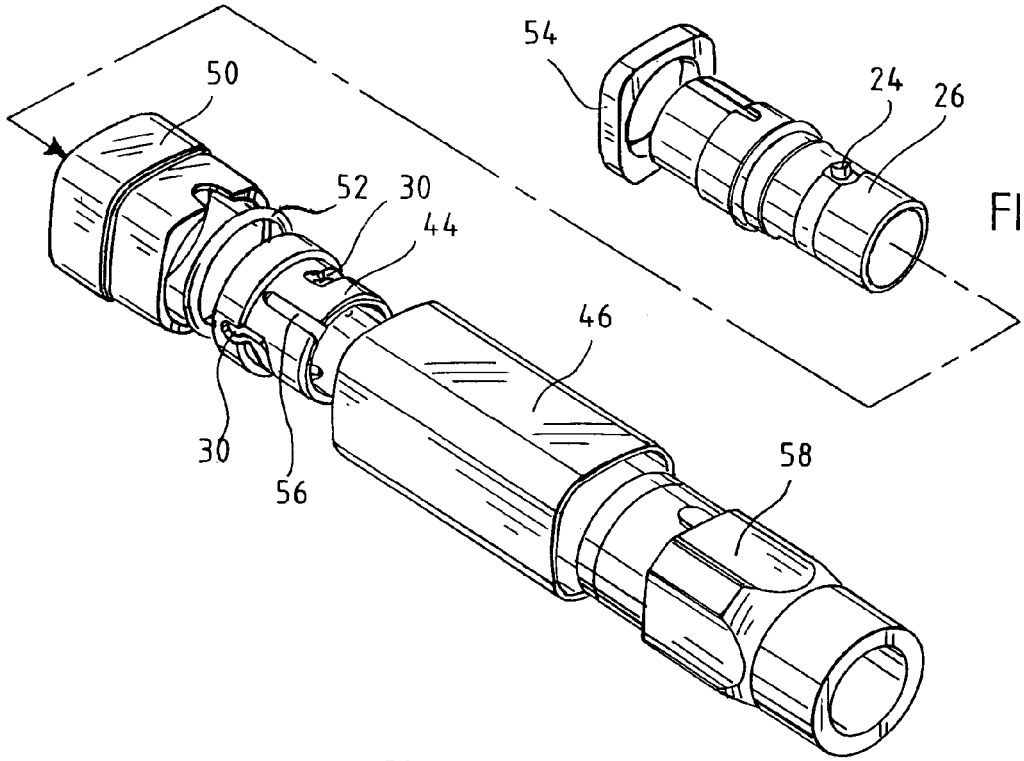
FIG. 8
FIG. 9
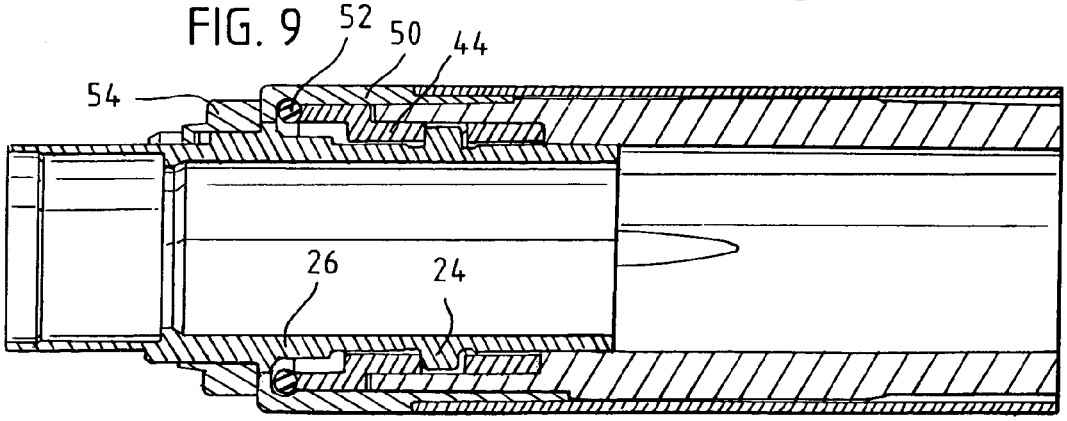

QUICK RELEASE MECHANISM FOR ACCESS TO INK RESERVOIR OF WRITING INSTRUMENT

FIELD OF THE DISCLOSURE

This disclosure relates generally to writing instruments and, more particularly, to an alternative mechanism for selective engagement of the barrel portions of a writing instrument for gaining access to the interior of the writing instrument to gain access, for example, to an ink reservoir stored therein.

BACKGROUND

The standard mechanism for selective engagement of the barrel portions of writing instruments consists of a male threaded end of one of the barrel portion and a complementary female threaded end of the other barrel portion. A user must impart at least one 360° revolution, and, more typically, several revolutions, of one of the barrel portions relative to the other in order to separate the two barrel portions for the purpose of gaining access to an ink retaining reservoir stored therein, such as for purposes of replacement of a low ink cartridge. In order to securely re-engage the two barrel portions, the user must again impart at least one 360° revolution, and, more typically, several revolutions, of one of the barrel portions relative to the other.

SUMMARY

A writing instrument including a first barrel portion having a writing point projecting from a first end is disclosed herein. The writing instrument further includes a second barrel portion adapted to selectively engage the first barrel portion via a selective engagement mechanism. The selective engagement mechanism is easy for a user to disengage, providing ready access to the interior of the writing instrument, enabling a user to, for example, change an ink reservoir stored therein. The selective engagement mechanism may include a docking collar extending from a second end, i.e. an engagement end, of the first barrel portion, opposite the first end. The docking collar includes one or more male projections extending laterally outward from the docking collar. For each male projection extending from the docking collar, the second barrel portion of the writing instrument is provided with a complementary track that constrains movement of the respective male projection, with an entrance to the track exposed at an engagement end of the second barrel portion.

The first barrel portion includes a first barrel portion engagement surface at the second end, and the second barrel portion includes a second barrel portion engagement surface at its engagement end. The distance between the first barrel portion engagement surface and each male projection on the docking collar is fixed. At least one of the complementary tracks is shaped such that when a male projection reaches a terminus of the track, the male projection is releasably secured in the track, thereby securing the first and second barrel portions together.

The selective engagement mechanism is provided with at least one biasing element to facilitate the releasable securement of the first and second barrel portions. In one embodiment, the biasing element includes a deformable, shape-recoverable gasket provided in the engagement end of the second barrel portion. A track-carrying member, in which the complementary tracks are provided, is also received in the engagement end of the second barrel portion, with the gasket disposed between the second barrel portion engagement surface and the track-carrying member. The track-carrying member has limited axial movement within the second barrel portion, and is biased away from the second barrel portion engagement surface by the gasket.

Each male projection of the docking collar associated with the first barrel portion moves within a respective complementary track upon relative movement of the first and second barrel portions until the first barrel portion engagement surface contacts the second barrel portion engagement surface. Upon continued relative movement of the first and second barrel portions, because of the fixed distance between the first barrel portion engagement surface and each of the male projections, as well as the shape of the complementary tracks, the axially movable track-carrying member is drawn axially toward the second barrel portion engagement surface, i.e. against the biasing force of the gasket, thereby compressing the gasket, until the male projection reaches a terminus of the track. The terminus of the track is widened in a direction of the entrance of the track, i.e. toward the second barrel portion engagement surface. Upon reaching this widened terminus, the track-carrying member is pushed axially by the gasket away from the second barrel portion engagement surface, such that the male projection pops into a releasable secured position in the widened terminus.

BRIEF DESCRIPTION OF THE SEVERAL VIEWS OF THE DRAWING

FIG. 6 is an enlarged cross-section view, taken along lines 6-6 of FIG. 5, showing one of the male projections extending laterally from a docking collar extending from the engagement end of one of the barrel portions just before entering a widened terminus of the complementary track of the engagement end of the other barrel portion;

FIG. 7 is a cross-sectional view similar to FIG. 6, showing the male projection received in the widened terminus of the complementary track.

FIG. 8 is an exploded view of components of an engagement mechanism of a writing instrument shown in FIGS. 3-7; and FIG. 9 is a cross-sectional view showing the first and second barrel portions of the writing instrument of FIG. 1 engaged with one another, utilizing the engagement mechanism shown in FIGS. 3-7 and the components shown in FIG. 8.

DETAILED DESCRIPTION OF THE PREFERRED EMBODIMENTS

Figure 1:
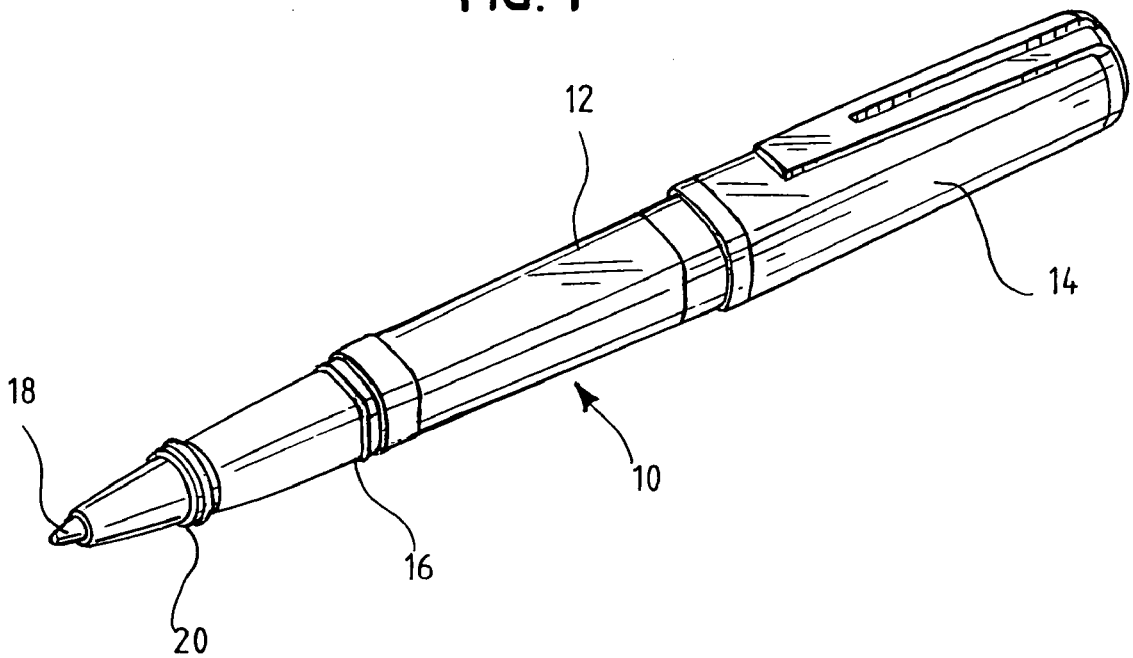
FIG. 1 is a perspective view of a writing instrument.
Figure 2:
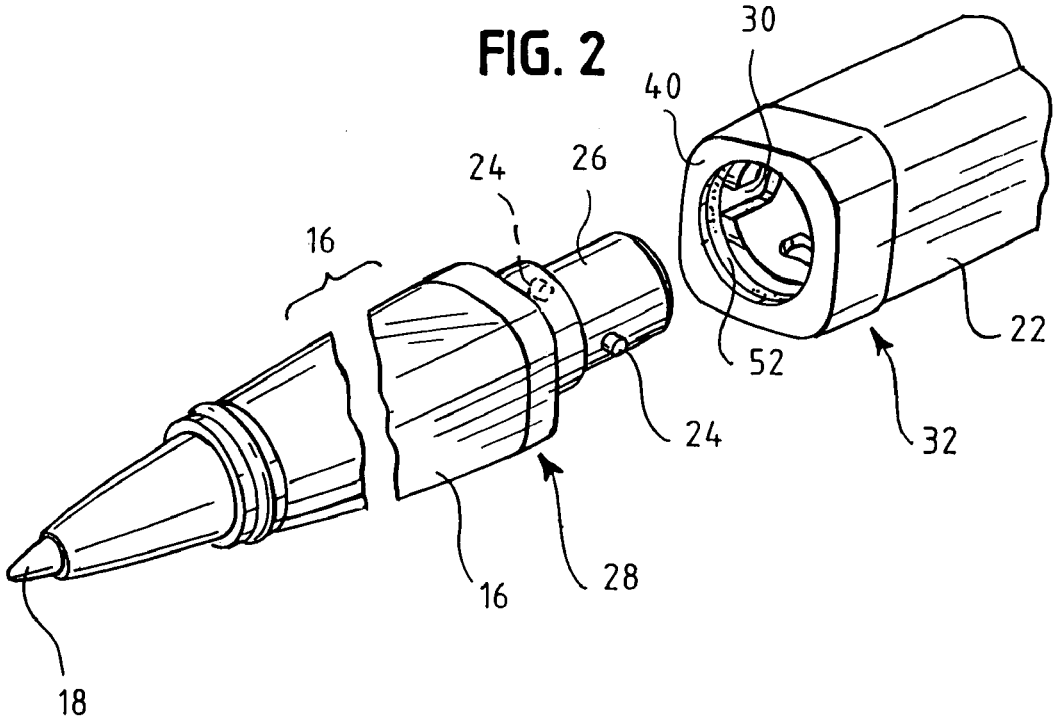
FIG. 2 is a partially exploded, cut-away view, showing the engagement mechanism of first and second barrel portions of the writing instrument of FIG. 1.

With reference to the drawing figures, a writing instrument 10 includes a main body 12 and a cap 14. The main body 12 includes a first barrel portion 16 having a writing tip 18 projecting from a first end 20. The main body 12 further includes a second barrel portion 22. The first barrel portion 16 and second barrel portion 22 are provided with an engagement mechanism that is easily releasable, as compared to threaded engagement mechanisms conventionally used in writing instruments. The engagement mechanism includes at least one male projection 24 extending laterally outwardly from a cylindrical docking collar 26 extending from a second end 28 of the first barrel portion 16, with the cylindrical docking collar 26 extending coaxially with the first barrel portion 16. In the embodiment shown in the drawing figures, two male projections 24 are provided on the docking collar 26, disposed opposite one another on the surface of the cylindrical docking collar 26.

For each male projection 24, at least one complementary track 30 is provided in an engagement end 32 of the second barrel portion 22. Each track 30 includes an entrance 34 to receive one of the male projections 24. Each track 30 extends in a first direction, such as axially, along the length of the writing instrument 10, until the track 30 reaches an intersection 34. At the intersection 36, the track 30 extends in at least one direction other than the first direction, until the track 30 reaches a terminus 38 thereof. At the terminus 38, the track 30 may widen, for example, in a direction toward the entrance 34.

It is recognized that the cylindrical docking collar 26 having the male projection(s) 24 need not be associated with the second end 28, or engagement end, of the first barrel portion 16 having the writing tip 18. For example, the cylindrical docking collar and male projection(s) 24 may instead be associated with the engagement end 32 of the second barrel portion 22, and the complementary track(s) 30 may be associated with the second end 28 of the first barrel portion 16. Alternatively, the male projection(s) 24 need not be provided on the docking collar 26, but may project laterally inwardly from an inside of one of the first and second barrel portions 16, 22, with at least one complementary track for each such inwardly-extending male projection being provided in a collar provided on the other of the first and second barrel portions 16, 22.

Figure 3:
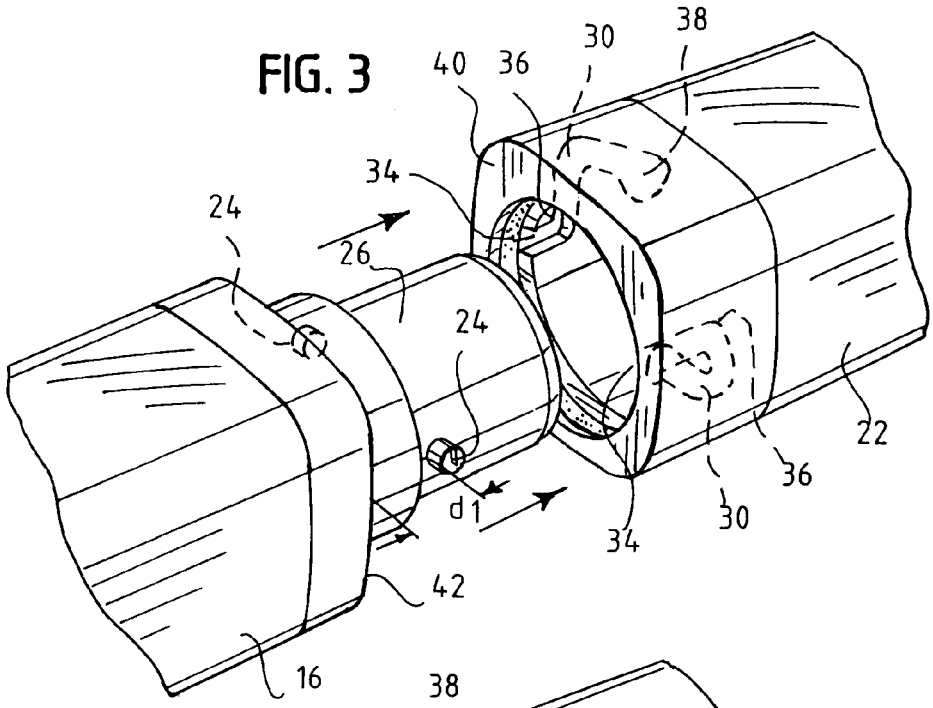
FIG. 3 is an enlarged perspective view, partially broken away for clarity, of an engagement mechanism of the first and second barrel portions of the writing instrument of FIG. 1, just prior to insertion of each of two male projections extending laterally from a docking collar extending from an engagement end of one of the barrel portions into an entrance of a complementary track (shown in phantom lines) provided in an engagement end of the other barrel portion.

Operation of the engagement mechanism is sequentially depicted in FIGS. 3-7. In FIG. 3, the first barrel portion 16 and second barrel portion 22 are arranged such that each of the male projections 24 is aligned with an entrance 34 of a track 30. In the embodiment shown in the drawing figures, the two male projections 24 are of the same size, and the two tracks 30 are of the same dimensions, such that there are two initial relative positions of the first and second barrel portions 16, 22 in which each of the male projections 24 is properly aligned with an entrance 34 of a track 30.

If it was desired to limit the user to one possible initial relative position of the first and second barrel portions 16, 22, several alternatives are within the scope of the present disclosure. For instance, only a single male projection and only a single complementary track could be provided.

Similarly, if it was desired to increase the number of possible initial relative positions of the first and second barrel portions 16, 22, there are several available alternatives within the scope of the present disclosure. For instance, three tracks may be provided, with entrances spaced at 120° intervals from one another, on one of the first and second barrel portions 16, 22, and three complementarily spaced male projections provided on the other of the first and second barrel portions 16, 22.

Figure 4:
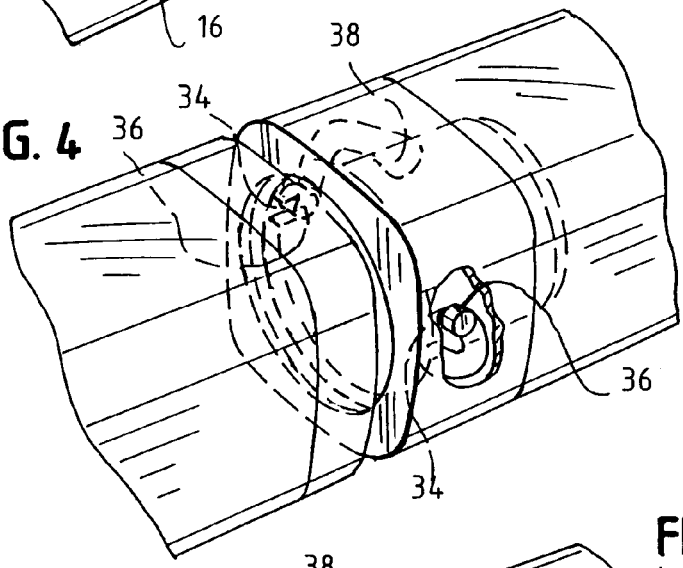
FIG. 4 is an enlarged perspective view, partially broken away for clarity, of the engagement mechanism of the first and second barrel portions of the writing instrument shown in FIG. 3, in which each of the two male projections extending laterally from a docking collar extending from an engagement end of one of the barrel portions reaches an intersection within the complementary track (shown substantially in phantom lines and partially in solid lines) provided in the engagement end of the other barrel portion.

After each of the male projections 24 is aligned with the entrance of a respective track 30, the first barrel portion 16 is advanced in the direction toward the second barrel portion 22, as indicated by the arrows in FIG. 3. Each of the male projections 24 moves into the entrance 34 of the respective track 30, and as the user continues to move the first barrel portion 16 toward the second barrel portion 22, each male projection 24 follows the respective track 30 in the first direction until the male projection 24 reaches the intersection 36, as shown in FIG. 4.

Figure 5:
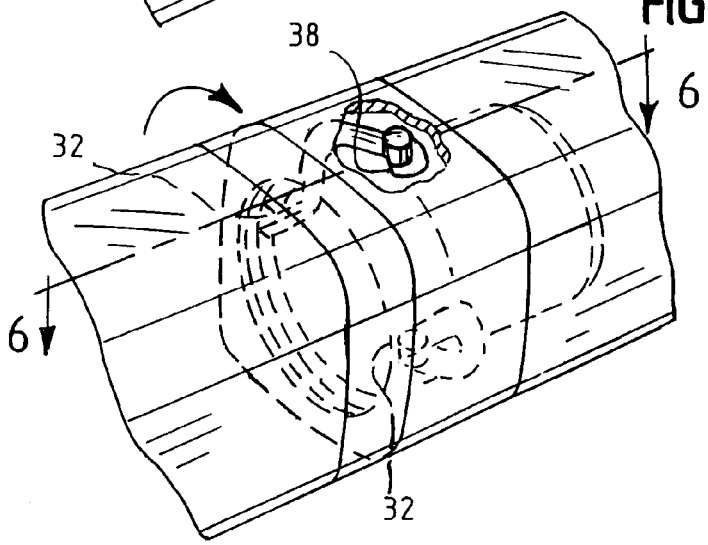
FIG. 5 is an enlarged perspective view, partially broken away for clarity, of the engagement mechanism of the first and second barrel portions shown in FIGS. 3 and 4, in which each of the male projections extending laterally from a docking collar extending from the engagement end of one of the barrel portions reaches a position just before entering a widened terminus of the complementary track (shown substantially in phantom lines and partially in solid lines) of the engagement end of the other barrel portion.

The user then turns the first barrel portion 16 relative to the second barrel portion 22, as indicated by the curved arrow in FIG. 5, so that each male projection 24 travels along the respective track 30 in a second direction until the male projection 24 reaches the terminus 38 of the track 30. In FIG. 5 and FIG. 6 (which is a cross-sectional view taken along lines 6-6 of FIG. 5) the male projections 24 are shown just before entering the terminus 38. FIG. 7 is a cross-sectional view similar to FIG. 6, but showing one of the male projections 24 received in the terminus 38. The tracks 30 shown in the drawings are shaped such that the user need only turn the first barrel portion 16 relative to the second barrel portion 22 less than 360°, and more specifically, no more than about ninety degrees, in order to secure the first and second barrel portions 16, 22 together.

The terminus 38 of each track 30 is widened in a direction other than the second direction, such as in a direction toward the entrance of the track 30, i.e. toward the engagement end 32 of the second barrel portion 22. When the male projection 24 reaches the widened terminus 38 of the track 30, as shown in FIG. 7, the male projection 24 pops into the widened terminus 38, thereby securing the first barrel 16 and second barrel 22 into a releasably locked engagement with one another. The user may hear an audible clicking sound, and/or feel a tactile sensation upon the male projection popping into the widened terminus 38.

In order to ensure that each male projection 24 pops into the widened terminus 38, a biasing element is provided. In the embodiment shown in the drawings, the biasing element is a deformable, shape-recoverable gasket 52. The gasket 52 is disposed in the second barrel portion 22, posteriorly (i.e., farther away from the writing tip 18 if the writing instrument 10 were fully assembled) of an engagement surface 40 at the engagement end 32 of the second barrel portion 22. The tracks 30 are provided in a track-carrying member 44 which is axially movable, to a limited extent, within the second barrel portion 22. The track-carrying member 44 is disposed posteriorly of the gasket 52, and is biased (by the gasket) in an axial direction away from the engagement surface 40.

The second end 28 of the first barrel portion 16 is also provided with an engagement contact surface 42. The axial distance between the male projections 24 and the engagement contact surface 42 is represented by the reference indicator $d_1$ in the drawing figures, as best seen in FIG. 3. The section of each of the tracks 30 extending between the intersection 36 and the widened terminus 38 may be gradually sloped in a direction away from the entrance 34, such that as the first barrel portion 16 is turned relative to the second barrel portion 22, the axial distance from the track to the engagement surface 40 gradually increases from less than $d_1$ (as best seen in FIG. 4, wherein the male projections 24 are at the respective intersections 36 of the track members 30, and a short distance still separates engagement surface 40 from engagement surface 42), to just slightly greater than $d_1$.

With such geometry, once the first barrel portion 16 is turned relative to the second barrel portion 22 to the point of contact of the engagement surfaces 40, 42, continued turning of the first barrel portion 16 relative to the second barrel portion 22 causes the male projections 24, constrained in the tracks 30, to impart forces which pull the track-carrying member 44 axially toward the engagement surface 40 (as indicated by the downwardly-directed arrows in FIG. 6), against the biasing force of the gasket 52. This pulling of the track-carrying member 44 toward the engagement surface 40 continues until the male projections 24 reach the widened terminus 38 of the respective track 30, as shown in FIG. 7, upon which the restoring force of the gasket 52 pushes the track-carrying member axially away from the engagement surface 40 (as indicated by the upwardly-directed arrows in FIG. 7), bringing a lower side of the male projection 24 into contact with the wall of the widened terminus 38.

In order to separate the first and second barrel portions 16, 22 from one another, the process is reversed. The user turns the first barrel portion 16 relative to the second barrel portion 22, causing the withdrawal of each of the male projections 24 from the widened terminus 38 of the respective track 30. The user continues turning the first barrel portion 16 until the male projections 24 reach the intersections 36. The user then pulls the first barrel portion 16 and second barrel portion 22 axially away from one another until the first and second barrel portions 16, 22 separate, thereby exposing an interior of the writing instrument 10 so as to provide access to, for example, an ink reservoir stored therein.

Various components may be employed in a writing instrument to achieve the selective engagement mechanism disclosed herein. In FIGS. 8 and 9, an exemplary set of components is shown. The docking collar 26 having a pair of male projections 24 extending laterally outwardly therefrom is shown in the exploded view of FIG. 8. An anterior portion of the docking collar 26 is received in a first barrel portion retaining member 54, which serves to retain the docking collar 26 at the second end 28 of the first barrel portion 16. The engagement surface 42 of the first barrel portion 16 is preferably provided on the first barrel portion retaining member 54.

The track-carrying member 44 and the gasket 52 are received in a second barrel portion retaining member 50, which serves to retain the track-carrying member 44 and gasket 52 near the engagement end 32 of the second barrel portion 22. The engagement surface 40 of the second barrel portion 22 is preferably provided on the second barrel portion retaining member 50.

In order to prevent rotation of the track-carrying member 44 relative to the second barrel portion 22, the track-carrying member may be provided with a rotation-limiting channel 56, as shown in FIG. 8. A rotation-preventing projection (not shown) which is fixed relative to the inside of the second barrel portion 22 is received in the rotation-limiting channel.

It is recognized that writing instruments of various cross-sectional exterior shapes would benefit from the quick-release selective engagement mechanism of the present disclosure. The writing instrument 10 depicted in the drawing figures has a generally rectangular cross-sectional exterior shape. The selective engagement mechanism disclosed herein is particularly well suited to maintaining axial alignment of the first and second barrel portions 16, 22 having such generally rectangular cross-sectional exterior shapes. As shown in FIG. 8, in order to prevent the rotation of the track-carrying member 44, the rotation-preventing projection (not shown) may be provided in a rectangular insert 46, or in a cylindrical-to-rectangular adapter member 58. The docking collar 26 and the track-carrying member 44 are preferably made of a precision-machined metal, with the male projections 24 preferably being integral extensions of the docking collar 26. The first barrel portion retaining member 54 and second barrel portion retaining member 50 are also preferably made of a precision-machined metal.

While certain embodiments are specifically described herein, the present disclosure is not intended to be limited thereto, and it is recognized that variations may be made that are within the scope of the appended claims.

We claim:

1. A writing instrument comprising:

a first barrel portion having a writing tip projecting from a first end thereof;

a second barrel portion selectively engageable with the first barrel portion; and a securement mechanism including at least one male projection associated with an engagement end of one of the first and second barrel portions and at least one complementary track associated with an engagement end of the other of the first and second barrel portions, wherein the at least one complementary track is provided in a track-carrying member disposed in an engagement end of one of the first and second barrel portions, the track-carrying member being axially movable within the engagement end of the barrel portion in which the track-carrying member is disposed, and the track-carrying member is biased by a gasket toward one of the first and second barrel portions to urge securement of the first and second barrel portions;

wherein the engagement end of the barrel portion in which the track-carrying member is disposed includes an engagement surface, and the gasket is disposed between the track-carrying member and the engagement surface.

2. The writing instrument of claim 1, wherein the at least one complementary track includes an entrance open in a direction toward the engagement surface of the barrel portion in which the track-carrying member is disposed and a terminus that widens in the direction toward the engagement surface, and wherein the gasket biases the track-carrying member in an axial direction away from the engagement surface of the barrel portion in which the track-carrying member is disposed.

* * * * *